US008250981B1

(12) United States Patent
Gotzmer et al.

(10) Patent No.: US 8,250,981 B1
(45) Date of Patent: Aug. 28, 2012

(54) UNDERWATER HYDRO-REACTIVE EXPLOSIVE SYSTEM

(75) Inventors: Carl Gotzmer, Accokeek, MD (US); Steven Kim, Crofton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 150 days.

(21) Appl. No.: 12/657,878

(22) Filed: Jan. 21, 2010

(51) Int. Cl.
*F42B 15/22* (2006.01)
*F42C 14/04* (2006.01)

(52) U.S. Cl. ..... 102/314; 102/399; 102/416

(58) Field of Classification Search ..... 102/314, 102/315, 320, 322, 325, 327, 332, 399, 406, 102/416
See application file for complete search history.

(56) References Cited

U.S. PATENT DOCUMENTS

| | | | | |
|---|---|---|---|---|
| 4,188,884 | A | 2/1980 | White et al. | |
| 4,280,409 | A * | 7/1981 | Rozner et al. | 102/364 |
| H464 | H * | 5/1988 | Lee et al. | 102/364 |
| 4,950,460 | A * | 8/1990 | Goodwin et al. | 422/239 |
| 5,212,343 | A | 5/1993 | Brupbacher et al. | |
| 6,131,518 | A | 10/2000 | Hains | |
| 6,354,220 | B1 | 3/2002 | Graham et al. | |
| 6,736,069 | B2 | 5/2004 | Kim | |
| 7,468,484 | B1 * | 12/2008 | Yatsenko | 114/20.1 |

* cited by examiner

*Primary Examiner* — James Bergin
(74) *Attorney, Agent, or Firm* — Fredric Zimmerman

(57) ABSTRACT

An underwater hydro-reactive explosive system includes a pressure vessel with a central section of water disposed between identical sections of a material selected from the group consisting of thermites, intermetallics, nano-sized metallic particles, and micro-sized metallic particles. The water is provided in a stoichiometric quantity that provides a complete reaction with the material following simultaneous detonation of the sections thereof.

16 Claims, 1 Drawing Sheet

UNDERWATER HYDRO-REACTIVE EXPLOSIVE SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to underwater explosives, and more particularly to a hydro-reactive explosive system for generating an explosion in an underwater environment.

BACKGROUND OF THE INVENTION

Underwater explosive devices include hydro-reactive devices in which elements of the device react exothermically to form a hot reaction mass that produces an explosion when the reaction mass comes into contact with water. The explosion produces shock energy, bubble energy, and impulse. Ideally, the explosion is generated with little or no waste energy production and little or no material waste in the form of unreacted elements.

SUMMARY OF THE INVENTION

Accordingly, it is an object of the present invention to provide an underwater hydro-reactive explosive system.

Another object of the present invention is to provide a hydro-reactive explosive system that efficiently generates explosion products.

Other objects and advantages of the present invention will become more obvious hereinafter in the specification and drawings.

In accordance with the present invention, an underwater hydro-reactive explosive system includes a pressure vessel with a hydro-reactive explosive stack confined therein. The stack includes a central section of water disposed between identical sections of a material selected from the group consisting of thermites, intermetallics, nano-sized metallic particles, and micro-sized metallic particles. The water is provided in a stoichiometric quantity that provides a complete reaction with the material following simultaneous detonation of the sections thereof.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
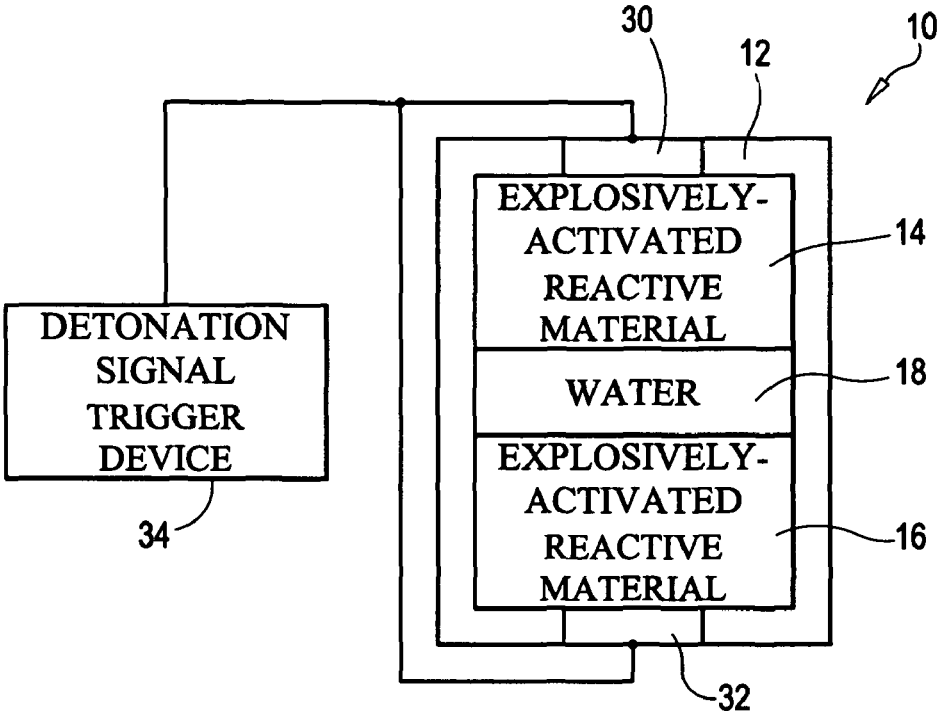
FIG. 1 is a schematic view of an underwater hydro-reactive explosive system in accordance with an embodiment of the present invention.

Referring now to the drawings and more particularly to FIG. 1, an underwater hydro-reactive explosive system in accordance with the present invention is shown and is referenced generally by numeral 10. Explosive system 10 can be a stand-alone system or could be incorporated into a delivery vehicle (e.g., a torpedo) without departing from the scope of the present invention. Further, the term "underwater" as used herein refers to seawater and fresh water environments.

Explosive system 10 includes an outer housing 12, and two sections 14 and 16 of explosively-activated reactive material sandwiching a chamber of water 18. Identical detonators 30 and 32 are coupled to the outermost and opposing end regions of sections 14 and 16, respectively, and a single detonation signal trigger device 34 is coupled to detonators 30 and 32. Housing 12 can completely envelope/encase sections 14/16 and water 18 therein up to detonators 30 and 32 as shown. However, the present invention is not so limited as housing 12 could also encase detonators 30 and 32 without departing from the scope of the present invention. Still further, housing 12 can be defined by a portion of a delivery vehicle designed to transport explosive system 10 to a desired underwater detonation location. As will be explained further below, housing 12 is generally constructed to operate as a pressure vessel that temporarily confines an explosion generated when sections 14/16 react with water 18. Such pressure vessel construction and materials used to construct the pressure vessel are well understood in the art.

In general, sections 14 and 16 are identically configured in terms of an exothermic reaction mass generated when they are explosively driven into water 18. Prior to activation of system 10, sections 14 and 16 include a reactive material that is kept isolated from water 18. The reactive material for this embodiment is a material that generates hot products when detonated. The detonation also drives the hot products into water 18 where they react therewith to form an explosion. Such reactive materials include thermites, intermetallics (e.g., titanium/boron), or metallic particles mixed with a high explosive such as TNT, RDX, HMX, etc.

When, system 10 is activated by means of a simultaneous detonation of detonators 30 and 32 (via trigger device 34), the reactive material in each of sections 14 and 16 is simultaneously converted to hot products and is driven in opposing fashion into water 18. By explosively driving the hot products into water 18 from opposing locations/directions, fast mixing and heating of the reactive material and water 18 occurs. At the same time, the opposing shock waves from the simultaneous detonation occurring in sections 14 and 16 creates a mach stem in water 18 thereby increasing the temperature, pressure and turbulent mixing occurring in water 18. As mentioned above, housing 12 is designed to briefly confine and inwardly direct the shockwaves associated with the simultaneous detonations and then fragment and disperse radially outward when the shockwaves impact housing 12.

Water 18 can be fresh water (e.g., tap water, distilled water, environmental water, etc.) or seawater without departing from the scope of the present invention. The amount of water 18 provided in system 10 should be a stoichiometric amount necessary for water 18 to form a complete reaction with the hot products driven therein from sections 14 and 16 upon the simultaneous detonation thereof.

Figure 2:
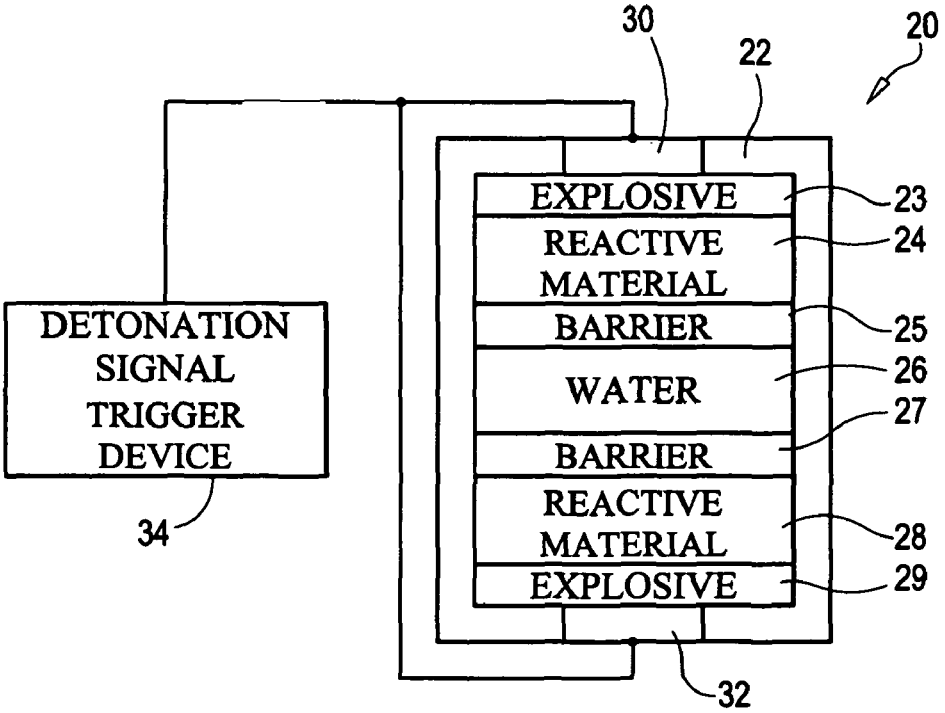
FIG. 2 is a schematic view of an underwater hydro-reactive explosive system in accordance with another embodiment of the present invention.

Another embodiment of the present invention is illustrated in FIG. 2 and is referenced generally by numeral 20. Explosive system 20 includes a cylindrical housing 22 containing a layered arrangement of elements in accordance with the present invention. Starting at one axial end of housing 22, explosive system 20 has the following: an explosive 23 fitted in and sealed against one axial end of housing 22; a pure-fuel reactive material 24 (e.g., micro or nano-sized metallic particles such as aluminum or magnesium that react/explode in the presence of water) adjacent explosive 23 and spanning a section of housing 22; a liquid-impervious barrier 25 adjacent reactive material 24 and spanning the diameter of housing 22 and sealed thereto; water 26 adjacent barrier 25 and filling a section of housing 22; a liquid-impervious barrier 27 that (i) is adjacent water 26, (ii) spans the diameter of housing 22 and sealed thereto, and (iii) opposes barrier 25, where the combination of housing 22 and barriers 25/27 contains water 26; a pure-fuel reactive material 28 adjacent barrier 27 and spanning a section of tube 22 where material 28 is identical to material 24 in terms of type, amount, etc.; and an explosive 29 fitted in and sealed against an opposing axial end of housing 22.

As in the previous embodiment, identical detonators 30 and 32 are coupled to explosives 23 and 29, respectively, and a single detonation signal trigger device 34 is coupled to detonators 30 and 32. Also as in the previous embodiment, housing 22 can be sealed against detonators 30 and 32 (as shown) or could completely encase same. Explosives 23 and 29 should be identically configured (i.e., type, amount, etc.), as should reactive materials 24 and 28. When explosives 23 and 29 are simultaneously detonated, reactive materials 24/28 are heated, dispersed and driven into water 26 where materials 24 and 28 react therewith to generate an explosion. The stoichiometric amount of water 26 should be sufficient to ensure that water 26 forms a complete reaction with reactive materials 24 and 28 as they are simultaneously explosively-driven into water 26.

By explosively driving the hot and dispersed reactive materials 24 and 28 into water 26 from opposing locations/directions, fast mixing and heating of the dispersed reactive materials 24/26 and water 26 occurs. At the same time, the opposing shock waves from the simultaneous detonation creates a mach stem in water 26 thereby increasing the temperature, pressure and turbulent mixing occurring in water 26. Similar to housing 12, housing 22 is designed to briefly confine and inwardly direct the shockwaves associated with the simultaneous detonations.

The advantages of the present invention are numerous. The simultaneous and opposing driving of reactive materials into a confined section of water generates fast and efficient mixing of the fuel/oxidizer to improve both the efficiency and intensity of the explosion.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed as new and desired to be secured by Letters Patent of the United States is:

1. An underwater hydro-reactive explosive system, comprising:

a pressure vessel;

a hydro-reactive explosive stack being confined within said pressure vessel, said stack including a central section of water disposed between identical sections of a reactive material selected from the group consisting of thermites, intermetallics, nano-sized metallic particles, and micro-sized metallic particles, where said reactive material is mixed with an explosive; and a detonator being coupled to each of said identical sections of said reactive material for causing a simultaneous detonation, wherein said water is provided in a quantity that provides a complete reaction with said reactive material following simultaneous detonation of said identical sections.

2. The system as in claim 1, wherein said pressure vessel is cylindrical.

3. The system as in claim 1, wherein said water is fresh water.

4. The system as in claim 1, wherein said water is seawater.

5. An underwater hydro-reactive explosive system, comprising:

a housing;

opposing and identical sections of reactive material disposed in said housing and spaced apart from one another to define a chamber in said housing;

water in said chamber, a water-impervious barrier disposed between said water and each of said sections of reactive material;

opposing and identical explosives disposed in said housing and sandwiching a combination of said sections of reactive material, each said water-impervious barrier, and said water, and detonators being coupled to each of said opposing and identical explosives for causing a simultaneous detonation thereof, wherein said water is provided in a quantity that provides a complete reaction with said sections of reactive material when said explosives are detonated simultaneously.

6. The system as in claim 5, wherein said housing is cylindrical.

7. The system as in claim 5, wherein said housing comprises a pressure vessel.

8. The system as in claim 5, wherein said reactive material is selected from the group consisting of nano-sized metallic particles and micro-sized metallic particles.

9. The system as in claim 5, wherein said water is fresh water.

10. The system as in claim 5, wherein said water is seawater.

11. An underwater hydro-reactive explosive system, comprising:

a housing;

a layered arrangement sealed within said housing, said layered arrangement including in sequential and contiguous fashion;

a first explosive;

a first reactive material;

a first water-impervious barrier, water;

a second water-impervious barrier;

a second reactive material; and a second explosive; and detonators being coupled to said first explosive and said second explosive for causing a simultaneous detonation, wherein said first explosive and said second explosive are identically configured, wherein said first reactive material and said second reactive material are identically configured, and wherein said water is provided in a quantity that provides a complete reaction with said first reactive material, and wherein said second reactive material follows simultaneous detonation of said first explosive and said second explosive.

12. The system as in claim 11, wherein said housing is cylindrical.

13. The system as in claim 11, wherein said housing comprises a pressure vessel.

14. The system as in claim 11, wherein said first reactive material and said second reactive material are selected from the group consisting of nano-sized metallic particles and micro-sized metallic particles.

15. The system as in claim 11, wherein said water is fresh water.

16. The system as in claim 11, wherein said water is seawater.

* * * * *